US011332818B2

(12) United States Patent
Nakajima et al.

(10) Patent No.: US 11,332,818 B2
(45) Date of Patent: May 17, 2022

(54) METHOD FOR PRODUCING SURFACE-HARDENED MATERIAL

(71) Applicant: NIHON PARKERIZING CO., LTD., Tokyo (JP)

(72) Inventors: Ryu Nakajima, Tokyo (JP); Taro Ito, Tokyo (JP); Tatsuya Matsukawa, Tokyo (JP); Masaaki Beppu, Atsugi (JP)

(73) Assignee: NIHON PARKERIZING CO., LTD., Tokyo (JP)

( * ) Notice: Subject to any disclaimer, the term of this patent is extended or adjusted under 35 U.S.C. 154(b) by 0 days.

(21) Appl. No.: 17/270,960

(22) PCT Filed: Aug. 23, 2019

(86) PCT No.: PCT/JP2019/032980
§ 371 (c)(1),
(2) Date: Feb. 24, 2021

(87) PCT Pub. No.: WO2020/045266
PCT Pub. Date: Mar. 5, 2020

(65) Prior Publication Data

US 2021/0214833 A1 Jul. 15, 2021

(30) Foreign Application Priority Data

Aug. 31, 2018 (JP) ..... JP2018-163627

(51) Int. Cl.
*C23C 8/50* (2006.01)
*C21D 1/06* (2006.01)
*C23C 8/46* (2006.01)

(52) U.S. Cl.
CPC ..... *C23C 8/50* (2013.01); *C21D 1/06* (2013.01); *C23C 8/46* (2013.01)

(58) Field of Classification Search
CPC ..... C23C 8/50; C23C 8/46; C21D 1/06
See application file for complete search history.

(56) References Cited

U.S. PATENT DOCUMENTS

| | | | | |
|---|---|---|---|---|
| 4,765,847 | A | 8/1988 | Arai et al. | |
| 2008/0099108 | A1* | 5/2008 | Baudis | C23C 8/50 148/227 |

FOREIGN PATENT DOCUMENTS

| | | | |
|---|---|---|---|
| EP | 0264448 | A1 | 4/1988 |
| GB | 1185640 | A | 3/1970 |
| JP | S45009045 | B1 | 4/1970 |
| JP | S62040362 | A | 2/1987 |
| JP | S62070561 | A | 4/1987 |
| JP | H07138733 | A | 5/1995 |
| JP | 2012031480 | A | 2/2012 |
| JP | 2015059248 | A | 3/2015 |
| RU | 2003732 | C1 | 11/1993 |

OTHER PUBLICATIONS

International Search Report (in English and Japanese) and Written Opinion (in Japanese) issued in International Application No. PCT/JP2019/032980, dated Sep. 24, 2019, ISA/JP.
Extended European Search Report dated Feb. 16, 2022 in corresponding application No. 19853464.6.

* cited by examiner

*Primary Examiner* — Jessee R Roe
(74) *Attorney, Agent, or Firm* — Harness, Dickey & Pierce, P.L.C.

(57) ABSTRACT

A method for producing a surface-hardened material, comprising: an immersion step of immersing an iron steel material having nitrogen attached in the form of a solid solution on the surface thereof in a melt containing a chloride at a temperature ranging from 650° C. to 900° C.; and a cooling step of cooling the immersed iron steel material to a temperature equal to or lower than a martensitic transformation start temperature at a cooling rate equal to or higher than a lower critical cooling rare at which martensitic transformation starts.

5 Claims, No Drawings

METHOD FOR PRODUCING SURFACE-HARDENED MATERIAL

CROSS REFERENCE TO RELATED APPLICATIONS

This application is a U.S. National Phase Application under 35 U.S.C. 371 of International Application No. PCT/JP2019/032980 filed on Aug. 23, 2019, which claims the benefit of priority from Japanese Patent Application No. 2018-163627 filed on Aug. 31, 2018. The entire disclosures of all of the above applications are incorporated herein by reference.

TECHNICAL FIELD

The present invention relates to a method for producing a surface-hardened material hardened to the extent of a deep position by applying a predetermined treatment to a steel material of which a surface is in the form of a solid solution of nitrogen.

BACKGROUND ART

As a surface hardening treatment method for a steel material, conventionally, various methods have been developed. For example, Patent Literature 1 has disclosed a method in which a steel is subjected to soft nitriding treatment to form a nitride layer having a predetermined thickness on the surface, and then the treated steel is heated at 1000° C. to 1200° C. for 30 to 120 minutes. Further, Patent Literature 2 has disclosed a method in which after nitriding a metal mold material, the surface of the material is heated, and then cooled to a martensitic transformation starting temperature or less at a cooling rate equal to or higher than a critical cooling rate of martensitic transformation and 30° C./sec or less, to reduce or eliminate the nitrogen compound on the surface and further to diffuse nitrogen and form a solid solution of nitrogen inside the material, and to make the surface-hardened layer deeper than that of the nitriding treatment alone.

CITATION LIST

Patent Literature

Patent Literature 1: JP-A-2015-59248
Patent Literature 2: JP-A-07-138733

SUMMARY OF INVENTION

Technical Problem

However, in the methods disclosed in Patent Literatures 1 and 2, a large amount of nitrogen cannot be deeply permeated into a steel material of which a surface is in the form of a solid solution of nitrogen, or the surface layer is oxidized, and as a result of which there have been some cases where a rigid surface cannot be formed to the extent of a deep position in the steel material. In view of this, an object of the present invention is to solve the above problems, and to provide a method for producing a surface-hardened material having a rigid surface to the extent of a deep position of the material.

Solution to Problem

That is, the present invention includes the following ones.

(1) A method for producing a surface-hardened material, including:

an immersion step of immersing a steel material of which a surface is in a form of a solid solution of nitrogen in a molten material containing a chloride within a range of 650° C. to 900° C., and a cooling step of cooling the immersed steel material to a martensitic transformation starting temperature or less at a cooling rate equal to or higher than a lower critical cooling rate at which martensitic transformation starts;

(2) The method for producing a surface-hardened material described in the above (1), in which the steel material of which a surface is in a form of a solid solution of nitrogen further contains an iron-nitrogen compound layer as a surface layer;

(3) The method for producing a surface-hardened material described in the above (1) or (2), in which the steel material of which a surface is in a form of a solid solution of nitrogen is also the steel material of which a surface is in a form of a solid solution of carbon;

(4) The method for producing a surface-hardened material described in the above (1) or (2), further including a nitriding step of forming a solid solution of nitrogen on the surface of the steel material by nitriding the steel material;

(5) The method for producing a surface-hardened material described in the above (4), in which the nitriding treatment is gas nitriding treatment, gas soft nitriding treatment, plasma nitriding treatment, or salt-bath soft nitriding treatment.

(6) The method for producing a surface-hardened material described in the above (4) or (5), further including a carburizing step of carburizing the steel material before the nitriding step;

(7) The method for producing a surface-hardened material described in any one of the above (1) to (6), in which the steel material of which a surface is in a form of a solid solution of nitrogen (performed the nitriding treatment) contains C in a range of 0.01% or more and 1.5% or less,
Si in a range of 3% or less,
Mn in a range of 2% or less,
Cr, Mo, Cu, and Ni in a range of 5% or less in total,
Nb, Ti, V, and B in a range of 1% or less in total,
P in a range of 0.1% or less,
S in a range of 0.05% or less, and
Fe in a range of 70.0% or more and 99.5% or less, in % by mass; and (8) The method for producing a surface-hardened material described in any one of the above (1) to (6), in which the steel material of which a surface is in a form of a solid solution of nitrogen (performed the nitriding treatment) contains C in a range of 0.01% or more and 1.5% or less,
Si in a range of 3% or less,
Mn in a range of 2% or less,
Cr, Mo, Cu, and Ni in a range of 5% or less in total,
Nb, Ti, V, and B in a range of 1% or less in total,
P in a range of 0.1% or less, and
S in a range of 0.05% or less, in % by mass, and further contains Fe and unavoidable impurities as the balance.

Advantageous Effects of Invention

According to the present invention, a method for producing a surface-hardened material having a rigid surface to the extent of a deep position of the material can be provided.

DESCRIPTION OF EMBODIMENTS

The method for producing a surface-hardened material according to the present invention, including: an immersion step of immersing a steel material of which a surface is in a form of a solid solution of nitrogen in a molten material containing a chloride within a range of 650° C. to 900° C.; and a cooling step of cooling the immersed steel material to a martensitic transformation starting temperature or less at a cooling rate equal to or higher than a lower critical cooling rate at which martensitic transformation starts. Hereinafter, the present invention will be specifically described.

The expression "steel material of which a surface is in a form of a solid solution of nitrogen" means that nitrogen is in a solid solution state on a surface of the steel material. The steel material, on the surface of which a solid solution of nitrogen is to be formed, is not particularly limited as long as it contains at least iron and carbon and contains the iron in an amount of 70% by mass or more (preferably 80% by mass or more), and specifically, examples of the steel material include rolled steel for general structure, cold-rolled steel and steel strip, carbon steel for machine structural use, alloy steel for machine structural use, carbon tool steel, high speed tool steel, spring steel, and high carbon chrome bearing steel. In addition, a steel material having a plated film with a composition similar to that of the steel material can also be targeted. In this case, the compositions of the steel material and the plated film may be the same as each other, or may be different from each other. Further, the steel material may contain some elements other than the iron and carbon. Examples of the some elements include Si, Mn, Cr, Mo, Cu, Ni, Nb, Ti, V, B, P, S, and O. Among them, one element or two or more elements may be contained in the steel material, or all of the elements may be contained in the steel material.

The content of each of the elements contained in the steel material will be described. The content of C (carbon) is usually within the range of 0.01% by mass or more and 1.5% by mass or less, and preferably within the range of 0.4% by mass or more and 1.0% by mass or less. The content of Si (silicon) is usually 3% by mass or less, and preferably 1% by mass or less. The content of Mn (manganese) is usually 2% by mass or less, and preferably 0.6% by mass or less. The total content of Cr (chromium), Mo (molybdenum), Cu (copper), Ni (nickel), and the like is usually 5% by mass or less. The total content of Nb (niobium), Ti (titanium), V (vanadium), B (boron), and the like may be 1% by mass or less, and is preferably at the impurity level. The content of P (phosphorus) is usually 0.1% by mass or less, and preferably 0.05% by mass or less. The content of S (sulfur) is usually 0.05% by mass or less, and is preferably 0.03% by mass or less. The content of 0 (oxygen) is preferably at the impurity level.

In the present embodiment, the preferable steel material contains C within the range of 0.01% by mass or more and 1.5% by mass or less; Si in an amount of 3% by mass or less; Mn in an amount of 2% by mass or less; Cr, Mo, Cu, and Ni in an amount of 5% by mass or less in total; Nb, Ti, V, and B in an amount of 1% by mass or less in total; Pin an amount of 0.1% by mass or less; S in an amount of 0.05% by mass or less; and Fe in an amount of 70.0% by mass or more and 99.5% by mass or less, or Fe and unavoidable impurities as the balance. Specifically, examples of the preferable steel material include SPCC, S10C, S45C, S55C, SK65 (SK7), SK105 (SK3), SUJ2, SCM420, and SCM440, in terms of Japanese Industrial Standard (JIS) steel grade. These steel materials may be steel materials that have been annealed or spheroidizing-annealed in advance.

An example of the method for forming a solid solution of nitrogen on a surface of the steel material includes nitriding treatment for a steel material. The method for producing a surface-hardened material according to the present invention may further include a "nitriding step of forming a solid solution of nitrogen on the surface of the steel material by nitriding the steel material before the immersion step". Further, after the nitriding step and before the immersion step to be described later, the steel material of which a surface is in the form of a solid solution of nitrogen may be cooled, and the cooled steel material of which a surface is in the form of a solid solution of nitrogen may be washed. The nitriding treatment for the steel material is not particularly limited as long as it is a conventionally known method, and examples of the nitriding treatment include gas nitriding treatment, gas soft nitriding treatment, plasma nitriding treatment, and salt-bath soft nitriding treatment. In addition, in a case where a carburizing step to be described later is performed, carbonitriding treatment may be performed as the nitriding treatment. By performing such a nitriding treatment, a nitrogen diffusion layer in which nitrogen is dissolved as a solid solution, or a composite layer of the nitrogen diffusion layer and an iron-nitrogen compound layer formed on the nitrogen diffusion layer is formed on the surface of the steel material.

The content of the nitrogen in the above nitrogen diffusion layer is usually 0.05% by mass or more, but is not limited to such a value. Further, the iron-nitrogen compound in the iron-nitrogen compound layer is, for example, ε—$Fe_{2-3}N$; γ'—$Fe_4N$; Fex(N, C) [x is an arbitrary numerical value]; M×N [M represents a metal element contained in a steel material, for example, Cr, Ti, Si, or V, and x is an arbitrary numerical value] such as CrN, $Cr_2N$, TiN, $Si_3N_4$, or VN; or the like. The iron-nitrogen compound layer is formed so as to have a thickness usually within the range of 1 μm or more and 50 μm or less. Conditions such as temperature and time period for the nitriding treatment vary depending on the type of the steel material, the treatment method, or the like, but in general, the nitriding treatment is performed at a temperature of A1 transformation point or less for a predetermined time period, for example, within the range of 300° C. or more and 600° C. or less and further within the range of 5 minutes or more and 120 minutes or less. More specifically, in a case of the salt-bath soft nitriding treatment, the temperature is preferably within the range of 550° C. or more and 600° C. or less, and more preferably within the range of 570° C. or more and 590° C. or less. The treatment time period is preferably within the range of 60 minutes or more and 120 minutes or less.

The thickness of the iron-nitrogen compound layer can be obtained by measuring the cross section of a steel material of which a surface is in the form of a solid solution of nitrogen, which is obtained by subjecting a steel material to nitriding treatment, with an optical microscope or a scanning electron microscope. The composition of the iron-nitrogen compound layer can be obtained by electron probe micro-analyzer (EPMA) analysis. The thickness of the nitrogen diffusion layer can be measured as the thickness of a layer in the form of a solid solution of nitrogen simply dissolved in iron, or a composite layer dispersed and precipitated nitrides of alloy elements (Cr, V, Nb, Ti, and Al) in a parent phase in the form of a solid solution of nitrogen, by EPMA analysis.

The method for producing a surface-hardened material according to the present invention may further include a "carburizing step of carburizing the steel material" before the immersion step, more specifically, before the above nitriding step. By performing the carburizing step, carbon can be dissolved as a solid solution on a surface of the steel material. Further, by performing the carburizing step and the nitriding step, a steel material of which a surface is in the form of a solid solution of carbon and nitrogen can be obtained. In this regard, examples of the carburizing treatment include solid carburizing treatment; liquid carburizing treatment such as salt-bath carburizing treatment; gas carburizing treatment; vacuum carburizing treatment (vacuum gas carburizing treatment); and plasma carburizing treatment (ion carburizing treatment), but the carburizing treatment is not limited thereto. Conditions such as temperature and time period for the carburizing treatment vary depending on the type of the steel material, the treatment method, the depth of carbon permeation, or the like, but are appropriately set so that carbon is dissolved as a solid solution on a surface of the steel material. In this regard, in the method for producing a surface-hardened material according to the present invention, a treatment such as quenching, or tempering may be performed under suitable conditions in order to improve the surface hardness of the steel material after performing the carburizing step and before the nitriding step.

Immersion Step

The steel material of which a surface is in the form of a solid solution of nitrogen is then immersed in a molten material containing a chloride. By performing the immersion step, a larger amount of nitrogen dissolved as a solid solution on the surface of the steel material can be deeply permeated into the steel material, and further the surface layer can be prevented from being oxidized, and therefore, the surface strength can be improved also to the extent of a deep position by the cooling step to be described later. Examples of the chloride to be contained in a molten material include NaCl, KCl, and $BaCl_2$, but the chloride is not limited thereto. These chlorides may be used singly alone, or by mixing two or more kinds thereof. The molten material may or may not contain a metal nitrate and/or a metal carbonate, of Na, K, Ba, or the like. The temperature of immersion in the molten material (immersion temperature) is usually within the range of 650° C. or more and 900° C. or less. The reason for limiting the temperature in this range is that the surface hardness of the surface-hardened material cannot be sufficiently improved to the extent of a deep position unless the immersion is performed in this temperature range. The time period of immersion in the molten material varies depending on the type of the steel material for forming a solid solution of nitrogen on the surface, the immersion temperature, or the like, but is usually 5 minutes or more and 60 minutes or less, and preferably 5 minutes or more and 30 minutes or less.

Cooling Step

By quenching the steel material immersed in the above immersion step, the martensitic transformation is generated on the surface portion, and a surface-hardened material having a rigid surface to the extent of a deep position can be produced. The cooling (quenching) condition is not particularly limited as long as the cooling rate is a lower critical cooling rate at which the martensitic transformation starts (occurs) or more, and the cooling rate is preferably an upper critical cooling rate or more. The lower critical cooling rate and the upper critical cooling rate vary depending on the composition of the steel material to be immersed, and is generally 20° C./sec to 30° C./sec or more. In this regard, the cooling temperature is not particularly limited as long as it is a martensitic transformation starting temperature or less. Further, the cooling (quenching) method is not particularly limited, and in the method, it is preferable to immerse the steel material in a cooling medium such as water, salt water, a polymer dispersed aqueous solution, oil, a salt bath, or a lead bath. After performing the cooling step, the above cooled steel material may be washed with water, or may be further tempered after the washing with water. By performing the tempering, a surface-hardened material having improved toughness can be produced. The tempering can be performed under the conditions usually set. The conditions such as tempering temperature and time period vary depending on the composition of the above cooled steel material, or the use application, and examples of the conditions include a temperature within the range of 150° C. or more and 180° C. or less, and a time period within the range of 60 minutes or more and 90 minutes or less.

EXAMPLES

In order to confirm the effect of the production method according to the present invention, seven kinds of test pieces were prepared. In this regard, the component compositions of JIS steel grade, which are used to prepare the test pieces, are shown in Table 1. The balance is iron and impurities, and the unit is % by mass.

(1) Test Piece 1

A carbon steel for machine structural use S45C was annealed at 850° C. for 4 hours, and formed into a piece of 20 mm in diameter×50 mm in length by machining to prepare a test piece 1.

(2) Test Piece 2

A dead soft steel sheet for automobile SPCC having a thickness of 1 mm was cut into a piece of 70 mm×150 mm in size to prepare a test piece 2.

(3) Test Piece 3

S10C was annealed at 900° C. for 4 hours, and formed into a piece of 20 mm in diameter×50 mm in length by machining to prepare a test piece 3.

(4) Test Piece 4

S55C was annealed at 850° C. for 4 hours, and formed into a piece of 20 mm in diameter×50 mm in length by machining to prepare a test piece 4.

(5) Test Pieces 5 and 6

SCM420 was annealed at 850° C. for 4 hours, and formed into a piece of 20 mm in diameter×50 mm in length by machining to prepare a test piece 5. This test piece was carburized at 930° C. for 180 minutes in a carburizing furnace while injecting propane converted gas (RX gas) and propane-enriched gas. After that, the temperature was lowered to 850° C., and then oil cooling (quenching) was performed, the test piece was tempered so that the effective case depth (550 HV) was 0.8 mm, the surface is mechanically polished so that the test piece was formed to be a piece of 20 mm in diameter×50 mm in length, and thus a test piece 6 on the surface of which a carburized layer was provided was prepared. In this regard, the effective case depth was measured on the basis of the "Methods of measuring case depth hardened by carburizing treatment for steel" in JIS G 0557: 2006.

(6) Test Piece 7

SCM440 was spheroidizing-annealed, and formed into a piece of 20 mm in diameter×50 mm in length by machining to prepare a test piece.

TABLE 1

| JIS steel grade | C | Si | Mn | Cr | Mo | Ni | P | S |
|---|---|---|---|---|---|---|---|---|
| S45C | 0.42-0.48 | 0.15-0.35 | 0.60-0.90 | — | — | — | ≤0.030 | ≤0.035 |
| SPCC | ≤0.15 | — | ≤0.60 | — | — | — | ≤0.100 | ≤0.050 |
| S10C | 0.08-0.13 | 0.15-0.35 | 0.30-0.60 | — | — | — | ≤0.030 | ≤0.035 |
| S55C | 0.52-0.58 | 0.15-0.35 | 0.60-0.90 | — | — | — | ≤0.030 | ≤0.035 |
| SCM420 | 0.18-0.23 | 0.15-0.35 | 0.60-0.90 | 0.90-1.20 | 0.15-0.25 | ≤0.25 | ≤0.030 | ≤0.030 |
| SCM440 | 0.38-0.43 | 0.15-0.35 | 0.60-0.90 | 0.90-1.20 | 0.15-0.30 | ≤0.25 | ≤0.030 | ≤0.030 |

Preparation of Evaluation Materials of Nos. 1 to 5

A test piece 1 was immersed in a salt-bath soft nitriding agent (NS-2 manufactured by Parker Netsushori Kogyo Co., Ltd.), and was subjected to salt-bath soft nitriding treatment at 570° C. for 120 minutes. As a result of observation on the test piece 1 that had been subjected to the salt-bath soft nitriding treatment, by an optical microscope and EPMA analysis, it was confirmed that a composite layer of an iron-nitrogen compound layer having a thickness of around 15 μm from the surface, and a nitrogen diffusion layer having a thickness of around 200 μm below the iron-nitrogen compound layer was formed. The test piece 1 that had been subjected to the salt-bath soft nitriding treatment was immersed in a salt bath agent containing a chloride metal salt, and heated in a salt bath at 600° C. to 1000° C. for 30 minutes. As the salt bath agent, GS540 (melting point 540° C.) manufactured by Parker Netsushori Kogyo Co., Ltd. was used in a case of heating at 600° C. or 650° C., and GS660 (melting point 660° C.) manufactured by Parker Netsushori Kogyo Co., Ltd. was used in a case of heating at 800 to 1000° C. After the heating in a salt bath, the test piece 1 was immersed in a 5% NaCl aqueous solution at 20° C. to 30° C. for cooling (hereinafter, also referred to as "water cooling"), and evaluation materials of Nos. 1 to 5 were prepared. The cooling rate at this time period was mostly 170° C./sec.

Preparation of Evaluation Materials of Nos. 6 to 10

A test piece 1 was subjected to plasma nitriding treatment, and the test piece 1 that had been subjected to the plasma nitriding treatment was observed by an optical microscope and EPMA analysis. In this regard, $N_2$ gas and $H_2$ gas in the furnace were adjusted so that the volume ratio of the $N_2$ gas to the $H_2$ gas was 1:4, and the plasma nitriding treatment was performed at 570° C. for 6 hours under the reduced pressure of 3 torr. As a result of the observation with the optical microscope, it was confirmed that an iron-nitrogen compound layer was discontinuously formed on the surface, and further, a nitrogen diffusion layer was formed below the iron-nitrogen compound layer or formed with a thickness of around 200 μm from the surface. The surface of the test piece 1 that had been subjected to the plasma nitriding treatment was mechanically polished to remove a slight amount of the iron-nitrogen compound layer discontinuously formed on the surface, and then the resultant test piece 1 was immersed in a salt bath agent and water cooled in a similar manner as in the above, and evaluation materials of Nos. 6 to 10 were prepared.

Characteristic Evaluation

Characteristics (surface oxidation, and cross-sectional hardness) of each of evaluation materials of Nos. 1 to 10 were evaluated. As to the surface oxidation, the presence or absence of the peeling-off or falling-off of an oxide or the like from the surface of the test piece 1 during water cooling, and the thickness of the oxide scale on the surface in a case where the cross-section of each evaluation material was observed with a metallurgical microscope (observation magnification 500 times) were confirmed, and evaluated. When there was no peeling-off or falling-off, and the thickness of the oxide scale was less than 2 μm, it was determined to be a practical level, and the surface oxidation was evaluated as "absence". In other cases, that is, when the peeling-off or falling-off was confirmed, or when the thickness of the oxide scale was 2 μm or more, the surface oxidation was evaluated as "presence".

As to the cross-sectional hardness, after cutting each evaluation material, the cross section was mirror-polished by mechanical polishing, and then by using a microhardness tester (micro Vickers), the microhardness (HV) at a depth position of 300 μm from the surface was measured under a measuring load of 0.3 kgf.

The results are shown in Table 2.

TABLE 2

| No. | JIS steel grade | Nitriding treatment | Iron-nitrogen compound layer (μm) | Nitrogen diffusion layer (μm) | Heating | Temperature (° C.) | Time (minutes) | Cooling | Cooling rate (° C./s) | Results: Surface oxidation | Results: Cross-sectional hardness (HV) | |
|---|---|---|---|---|---|---|---|---|---|---|---|---|
| 1 | S45C | Salt-bath soft nitriding treatment | 15 | 200 | Salt-bath heating | 600 | 30 | Water cooling | 170 | Absence | 250 | Comparative Example |
| 2 | S45C | Salt-bath soft nitriding treatment | 15 | 200 | Salt-bath heating | 650 | 30 | Water cooling | 170 | Absence | 670 | Example |
| 3 | S45C | Salt-bath soft nitriding treatment | 15 | 200 | Salt-bath heating | 800 | 30 | Water cooling | 170 | Absence | 720 | Example |
| 4 | S45C | Salt-bath soft nitriding treatment | 15 | 200 | Salt-bath heating | 900 | 30 | Water cooling | 170 | Absence | 720 | Example |

TABLE 2-continued

| | | | | | | | | | | | | |
|---|---|---|---|---|---|---|---|---|---|---|---|---|
| 5 | S45C | Salt-bath soft nitriding treatment | 15 | 200 | Salt-bath heating | 1000 | 30 | Water cooling | 170 | Presence | 800 | Comparative Example |
| 6 | S45C | Plasma treatment | 0 | 200 | Salt-bath heating | 600 | 30 | Water cooling | 170 | Absence | 245 | Comparative Example |
| 7 | S45C | Plasma treatment | 0 | 200 | Salt-bath heating | 650 | 30 | Water cooling | 170 | Absence | 640 | Example |
| 8 | S45C | Plasma treatment | 0 | 200 | Salt-bath heating | 800 | 30 | Water cooling | 170 | Absence | 700 | Example |
| 9 | S45C | Plasma treatment | 0 | 200 | Salt-bath heating | 900 | 30 | Water cooling | 170 | Absence | 700 | Example |
| 10 | S45C | Plasma treatment | 0 | 200 | Salt-bath heating | 1000 | 30 | Water cooling | 170 | Presence | 735 | Comparative Example |

Preparation of Evaluation Materials of Nos. 11 to 18

The test piece 1 or 6 that had been subjected to the salt-bath soft nitriding treatment in a similar manner as in the above was observed by an optical microscope and EPMA analysis. As a result of the observation with the optical microscope, it was confirmed that an iron-nitrogen compound layer having a thickness of around 15 μm from the surface, and a nitrogen diffusion layer having a thickness of around 200 μm below the iron-nitrogen compound layer were formed.

The test piece 6 that had been subjected to the salt-bath soft nitriding treatment was heated in a salt bath at 800° C. for 5 minutes or 30 minutes, and then the resultant test piece 6 was immersed in a cold quenching oil (Daphne Master Quench A manufactured by Idemitsu Kosan Co., Ltd.) at 30 to 40° C. for cooling (hereinafter, also referred to as "oil cooling"), and evaluation materials of Nos. 11 and 12 were prepared. The cooling rate at this time was mostly 100° C./sec.

Further, the test piece 1 or 6 that had been subjected to the salt-bath soft nitriding treatment was heated at 800° C. for 5 or 30 minutes in an electric furnace (electric furnace heating). After the heating, the resultant test piece 1 or 6 was water-cooled or oil-cooled, and evaluation materials of Nos. 13 to 15 were prepared.

The test piece 6 that had been subjected to the salt-bath soft nitriding treatment was heated at 800° C. for 0.5 to 5 minutes by using a high-frequency power supply device (maximum output: 30 kW, frequency: 70 kHz) (IH). After the heating, the resultant test piece 6 was oil-cooled, and evaluation materials of Nos. 16 to 18 were prepared.

Characteristics of each of evaluation materials of Nos. 11 to 18 were evaluated in a similar manner as in the above. The results are shown in Table 3.

TABLE 3

| No. | JIS steel grade | Nitriding treatment | Iron-nitrogen compound layer (μm) | Nitrogen diffusion layer (μm) | Heating | Temperature (° C.) | Time (minutes) | Cooling | Cooling rate (° C./s) | Results: Surface oxidation | Results: Cross-sectional hardness (HV) | |
|---|---|---|---|---|---|---|---|---|---|---|---|---|
| 11 | Carburized SCM420 | Salt-bath soft nitriding treatment | 15 | 200 | Salt-bath heating | 800 | 5 | Oil cooling | 100 | Absence | 750 | Example |
| 12 | Carburized SCM420 | Salt-bath soft nitriding treatment | 15 | 200 | Salt-bath heating | 800 | 30 | Oil cooling | 100 | Absence | 770 | Example |
| 13 | Carburized SCM420 | Salt-bath soft nitriding treatment | 15 | 200 | Electric furnace heating | 800 | 5 | Oil cooling | 100 | Presence | 400 | Comparative Example |
| 14 | Carburized SCM420 | Salt-bath soft nitriding treatment | 15 | 200 | Electric furnace heating | 800 | 30 | Oil cooling | 100 | Presence | 530 | Comparative Example |
| 15 | S45C | Salt-bath soft nitriding treatment | 15 | 200 | Electric furnace heating | 800 | 30 | Water cooling | 170 | Presence | 444 | Comparative Example |
| 16 | Carburized SCM420 | Plasma treatment | 15 | 200 | IH | 800 | 0.5 | Oil cooling | 100 | Absence | 400 | Comparative Example |
| 17 | Carburized SCM420 | Plasma treatment | 15 | 200 | IH | 800 | 1 | Oil cooling | 100 | Presence | 750 | Comparative Example |
| 18 | Carburized SCM420 | Plasma treatment | 15 | 200 | IH | 800 | 5 | Oil cooling | 100 | Presence | 750 | Comparative Example |

Preparation of Evaluation Materials of Nos. 19 to 26

The test pieces 1 to 7 that had been subjected to the salt-bath soft nitriding treatment, were observed by an optical microscope and EPMA analysis in a similar manner as in the above. As a result of the observation with the optical microscope, it was confirmed that an iron-nitrogen compound layer having a thickness of around 15 μm from the surface, and a nitrogen diffusion layer having a thickness of around 200 μm below the iron-nitrogen compound layer were formed. The test pieces 1 to 7 that had been subjected to the salt-bath soft nitriding treatment were heated in a salt bath at 850° C. for 5 minutes, and then the resultant test pieces 1 to 7 were water-cooled or oil-cooled, and evaluation materials of Nos. 19 and 21 to 26 were prepared. Further, the test piece 6 that had been subjected to the salt-bath soft nitriding treatment was heated in a salt bath at 850° C. for 5 minutes, and then left to stand in a room at 20° C. for cooling to 20° C., and thus an evaluation material of No. 20 was prepared. The cooling rate at this time was mostly 10° C./sec. Characteristics of each of evaluation materials of Nos. 19 to 26 were evaluated in a similar manner as in the above. The results are shown in Table 4.

TABLE 4

| No. | JIS steel grade | Nitriding treatment | Iron-nitrogen compound layer (μm) | Nitrogen diffusion layer (μm) | Cross-sectional hardness (HV) | Heating | Temperature (° C.) | Time (minutes) | Cooling | Cooling rate (° C./s) | Results: Surface oxidation | Results: Cross-sectional hardness (HV) | |
|---|---|---|---|---|---|---|---|---|---|---|---|---|---|
| 19 | Carburized SCM420 | Salt-bath soft nitriding treatment | 15 | 200 | 400 | Salt-bath heating | 850 | 5 | Oil cooling | 100 | Absence | 762 | Example |
| 20 | Carburized SCM420 | Salt-bath soft nitriding treatment | 15 | 200 | 400 | Salt-bath heating | 850 | 5 | Air cooling | 10 | Presence | 513 | Comparative Example |
| 21 | SPCC | Salt-bath soft nitriding treatment | 15 | 200 | 165 | Salt-bath heating | 850 | 5 | Water cooling | 170 | Absence | 620 | Example |
| 22 | S10C | Salt-bath soft nitriding treatment | 15 | 200 | 172 | Salt-bath heating | 850 | 5 | Water cooling | 170 | Absence | 630 | Example |
| 23 | S45C | Salt-bath soft nitriding treatment | 15 | 200 | 235 | Salt-bath heating | 850 | 5 | Water cooling | 170 | Absence | 730 | Example |
| 24 | S55C | Plasma treatment | 15 | 200 | 204 | Salt-bath heating | 850 | 5 | Oil cooling | 100 | Absence | 720 | Example |
| 25 | SCM420 | Plasma treatment | 15 | 200 | 230 | Salt-bath heating | 850 | 5 | Oil cooling | 100 | Absence | 700 | Example |
| 18 | SCM440 | Plasma treatment | 15 | 200 | 230 | Salt-bath heating | 800 | 5 | Oil cooling | 100 | Absence | 730 | Example |

The invention claimed is:

1. A method for producing a surface-hardened material, comprising:

an immersion step of immersing a steel material of which a surface is in a form of a solid solution of nitrogen in a molten material containing a chloride within a range of 650° C. to 900° C.; and a cooling step of cooling the immersed steel material to a martensitic transformation starting temperature or less at a cooling rate equal to or higher than a lower critical cooling rate at which martensitic transformation starts.

2. The method for producing a surface-hardened material according to claim 1, wherein the steel material of which a surface is in a form of a solid solution of nitrogen further contains an iron-nitrogen compound layer as a surface layer.

3. The method for producing a surface-hardened material according to claim 1, further comprising a nitriding step of forming a solid solution of nitrogen on the surface of the steel material by nitriding the steel material.

4. The method for producing a surface-hardened material according to claim 3, further comprising a carburizing step of carburizing the steel material before the nitriding step.

5. The method for producing a surface-hardened material according to claim 1, wherein the steel material of which a surface is in a form of a solid solution of nitrogen is also the steel material of which a surface is in a form of a solid solution of carbon.

* * * * *